United States Patent [19]

Bejean et al.

[11] Patent Number: 4,961,591

[45] Date of Patent: Oct. 9, 1990

[54] LATERAL GUIDANCE APPARATUS FOR A CROSS-COUNTRY SKI BOOT

[75] Inventors: Alain Bejean, La Clusaz; Gerard Graillat, Annecy, both of France

[73] Assignee: Salomon, S.A., Annecy Cedex, France

[21] Appl. No.: 288,944

[22] Filed: Dec. 23, 1988

[30] Foreign Application Priority Data

Dec. 24, 1987 [FR] France ..... 87 18141

[51] Int. Cl.[5] ..... A63C 5/06

[52] U.S. Cl. ..... 280/607; 280/609; 280/615

[58] Field of Search ..... 280/615, 607, 609

[56] References Cited

U.S. PATENT DOCUMENTS

| | | | |
|---|---|---|---|
| 4,262,925 | 4/1981 | Plenk | 280/615 |
| 4,789,177 | 12/1988 | Graillat | 280/607 |

FOREIGN PATENT DOCUMENTS

| | | | |
|---|---|---|---|
| 370335 | 3/1983 | Austria . | |
| 2255406 | 5/1972 | Fed. Rep. of Germany | 280/607 |
| 3113941 | 10/1982 | Fed. Rep. of Germany . | |
| 2590131 | 5/1987 | France . | |
| 44-15097 | 7/1969 | Japan | 280/607 |

*Primary Examiner*—Charles A. Marmor
*Assistant Examiner*—Eric Culbreth
*Attorney, Agent, or Firm*—Sandler, Greenblum & Bernstein

[57] ABSTRACT

A lateral guidance apparatus for a ski boot including a longitudinal guidance element projecting from the ski for engagement with a complementary shaped groove in the sole of the boot. On either lateral side of the groove of the boot is a support surface for engagement with a support surface on the interior side of the guidance element and a support surface on the exterior side of the guidance element. With the boot supported upon the ski, the configuration of the support surfaces of the boot and the ski orient the boot, and the skier's lower leg, toward the interior side of the ski.

31 Claims, 2 Drawing Sheets

LATERAL GUIDANCE APPARATUS FOR A CROSS-COUNTRY SKI BOOT

BACKGROUND OF THE INVENTION

1. Field of the Invention

The present invention relates to a lateral guidance apparatus for a cross-country ski boot, including a longitudinal rib which projects from the upper surface of a ski, as well as a cross-country ski and boot adapted for this purpose.

2. Description of Background and Relevant Information

Cross-country skis which include a longitudinal rib on their upper surfaces are known. This rib can form an integral portion of the ski or it can be formed on a plate which is itself affixed to the upper surface of the ski. Such a rib generally has a generally trapezoidal cross-section. Otherwise stated, it is defined by an upper horizontal surface and two lateral inclined surfaces. The upper longitudinal rib contributes to the lateral guidance of the boot mounted on the cross-country ski, which is adapted for this purpose by virtue of the provision of a groove in its sole having a complementary shape in cross-section to that of the rib of the ski. During the flattening of the foot on the ski during the practice of cross-country skiing, the groove of the sole, in effect, progressively caps the lateral guidance rib which intervenes to laterally maintain the boot, and preferably well-centered, on the ski.

Cross-country skiers more and more often use a "skating" or "half-step skating" technique in which the skier, to ensure his or her propulsion on at least one of the skis, inclines the ski with respect to its direction of movement. Yet, with such a technique the skier often has a tendency to take "too much edge," i.e., there is an increased tendency for the skier to twist his or her ankle.

SUMMARY OF THE INVENTION

An object of the present invention is to overcome the aforementioned disadvantage in the prior art by providing a lateral guidance apparatus for a boot on a cross-country ski including, at its upper portion, a longitudinal rib having an internal side and an external side, the rib constituting a lateral guidance element for a boot having, in its sole, a longitudinal groove which caps the rib in the course of flattening the boot on the ski and a lower support zone on either side of the groove. The lateral guidance apparatus further includes two elastic elements positioned on opposite sides of the longitudinal rib, each elastic element having an upper surface, wherein the upper surfaces of the elastic external element and the elastic internal element and the lower support zones of the sole positioned on either side of the groove in the sole are positioned, with respect to one another, in a manner such that in the position of the sole substantially flattened on the ski, and the two elastic elements are compressed, the sole is inclined transversely from top to bottom and from the exterior of the ski towards the interior thereof.

According to a further aspect of the invention, the upper surface of the elastic element which is positioned on the exterior side of the ski is positioned at a level higher than the level of the upper surface of the elastic element which is positioned on the interior side of the ski.

According to a further aspect of the invention, an external shaped section and an internal shaped section are affixed to the ski and have respective upper surfaces. The external elastic element and the internal elastic element have substantially the same thickness and are, respectively, affixed on the horizontal upper support surfaces of the external shaped section and the internal shaped section. The horizontal support surface of the external shaped section is positioned at a level above that of the horizontal support surface of the internal shaped section.

According to a still further embodiment of the invention, the external elastic element has a thickness greater than that of the internal elastic element and the external shaped section and the internal shaped section are affixed, respectively, on the horizontal support surfaces of the shaped sections, which are positioned substantially at the same level.

According to a still further embodiment of the invention, the external elastic element and the internal elastic element are constituted by shaped sections totally made of elastic material, which include respective upper surfaces and which are substantially coplanar and inclined with respect to the horizontal, the inclination being such that the upper surface of the external shaped section is at a level above that of the upper surface of the internal shaped section.

According to a still further embodiment of the invention, a molded shaped section made of a rigid material substantially mates with the shape of the cross-country ski, the molded shaped section having upper support surfaces, respectively, on an external side and on an internal side of a portion of the molded shaped section which overlies the longitudinal rib. The upper support surfaces of the molded shaped section are substantially coplanar and inclined with respect to the horizontal such that the external upper support surface is positioned at a level above that of the internal upper support surface, and the external elastic element and the internal elastic element have substantially the same thickness and are situated, respectively, on the external upper support surface and the internal upper support surface.

According to a still further aspect of the invention, a plate is affixed to the ski and has an external wing and an internal wing with respective substantially horizontal upper surfaces. The longitudinal rib is formed integrally with the plate between the wings, the external elastic element and the internal elastic element have substantially the same thickness and are affixed respectively, on the upper horizontal surfaces of the external wing and the internal wing of the plate, the internal wing having a thickness less than that of the external wing.

According to a still further aspect of the invention, the external elastic element has a thickness greater than that of the internal elastic element, and the two elastic elements are respectively affixed on the upper horizontal surfaces of the external wing and the internal wing of the plate.

According to a still further aspect of the invention, the external elastic element and the internal elastic element have substantially the same thickness and are affixed on the upper respective surfaces of the wings and the upper surfaces of the wings are substantially coplanar and inclined with respect to the horizontal such that the internal upper surface is lower than the external upper surface.

According to a still further aspect of the invention, the external elastic element and the internal elastic element are affixed on the upper horizontal surfaces of the external wing and the internal wing, the external wing and the internal wing have substantially the same thickness and the upper surfaces of the elastic elements are substantially coplanar and are inclined with respect to the horizontal, such that the upper surface of the internal elastic element is lower than the upper surface of the external elastic element.

According to a still further aspect of the invention, the external elastic element and the internal elastic element have substantially the same thickness and are positioned at substantially the same level and the lower support zone of the sole situated on the interior side of the ski has a first predetermined height, with respect to the bottom of the groove, which is less than a second predetermined height of the lower support zone situated on the external side of the ski.

The present invention can be further defined as a lateral guidance apparatus for a ski boot including a longitudinal guidance element for being affixed to a ski and for engagement with a substantially complementary shaped groove in the sole of the boot; an internal longitudinally extending support surface located on an internal side of the longitudinal guidance element; an external longitudinally extending support surface located on an external side of the longitudinal guidance element; the internal longitudinally extending support surface and the external longitudinally extending support surface being configured and arranged relative to the boot and the ski during the course of skiing such that a longitudinal median plane of the boot is inclined relative to a longitudinal median plane of the ski.

According to a further aspect of the invention, an internal elastic element and an external elastic element are provided, wherein the internal elastic element includes the internal longitudinally extending support surface, and wherein the external elastic element includes the external longitudinally extending support surface.

According to a further aspect of the invention, the internal elastic element and the external elastic element have substantially the same thickness or different thicknesses.

According to a still further aspect of the invention, an internal shaped section is provided for engagement with an internal ski surface and an external shaped section is provided for engagement with an external ski surface, wherein the internal shaped section and the external shaped section each include an upper surface for supporting the internal elastic element and the external elastic element, respectively.

According to a still further aspect of the invention, a further section is provided connecting the internal shaped section and the external shaped section, wherein the further section is configured and arranged for overlying the longitudinal guidance element.

According to a still further aspect of the invention, a plate is provided in a longitudinally extending generally central portion from which the longitudinal guidance element projects. The plate includes a substantially continuous lower surface for engagement with a substantially continuous upper surface of the ski.

According to a still further aspect of the invention, the internal elastic element and an external elastic element are provided wherein the internal elastic element includes the internal longitudinally extending support surface, and wherein the external elastic element includes the eternal longitudinally extending support surface.

The present invention can be further defined as a sole of a ski boot including a longitudinally extending groove for engagement with a longitudinal guidance element of a ski for maintaining lateral guidance of the boot upon the ski; an interior lower support surface on an interior side of the groove for engagement with an interior ski support surface; an exterior lower support surface on an exterior side of the groove for engagement with an exterior ski support surface wherein, when the interior lower support surface and the exterior lower support surface engage a horizontal support surface, the ski boot sole tends to incline the lower leg of a skier towards an interior side of the ski when the ski boot is worn by the skier.

According to a further aspect of the invention, an interior projection includes the interior lower support surface and an exterior projection includes the exterior lower support surface, wherein the exterior support projection has a height greater than a height of the interior support projection.

BRIEF DESCRIPTION OF THE DRAWINGS

The invention will now be described with reference to the annexed drawings, given by way of non-limiting example only of various embodiments of the invention in which.

DESCRIPTION OF PREFERRED EMBODIMENTS

The present invention attempts to overcome the disadvantages noted above by ensuring an automatic elastic return of the boot at the beginning of the flattening movement of the foot of the skier, in an inclined position transversely towards the interior of the ski.

To this end, the lateral guidance apparatus of a boot on a cross-country ski includes, at its upper portion, a longitudinal rib, this rib constituting a lateral guidance element for a boot having, in its sole, a longitudinal groove which caps the rib during the flattening movement of the foot on the ski, and an elastic element positioned on either side of the longitudinal rib, wherein the upper surfaces of the external and internal elastic elements and the lower support zones of the portions of the sole situated on each side of the groove in the sole are positioned, with respect to one another, in a manner such that during the flattening the boot on the ski, when the two elastic elements are compressed, the boot is inclined transversely from top to bottom and from the exterior of the ski towards the interior thereof.

According to a first embodiment of the invention, the elastic element positioned on the exterior side of the ski has an upper surface positioned at a level above the level of the upper surface of the elastic element positioned on a lower interior side of the ski.

Figure 1:
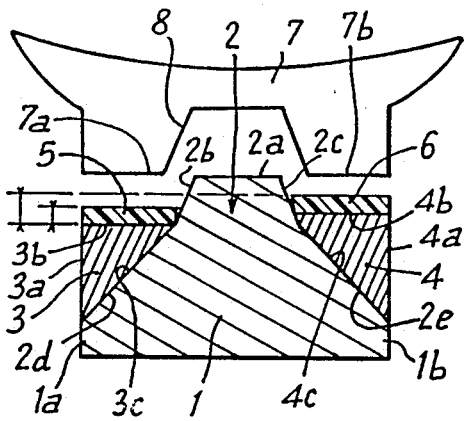
FIG. 1 is a vertical transverse cross-sectional view of a cross-country ski provided with a lateral guidance apparatus according to the invention, a cross-country ski boot cooperating with the ski being shown spaced from the lateral guidance rib.
Figure 2:
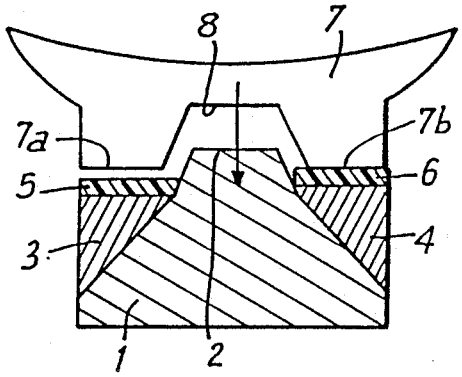
FIGS. 2 and 3 are vertical transverse cross-sectional views similar to those of FIG. 1, illustrating the ski and boot the moment in which the sole of the boot comes into contact only with the external elastic element, and at the moment in which the sole flattens the two elastic elements, after the flattening of the boot on the ski, respectively.
Figure 3:
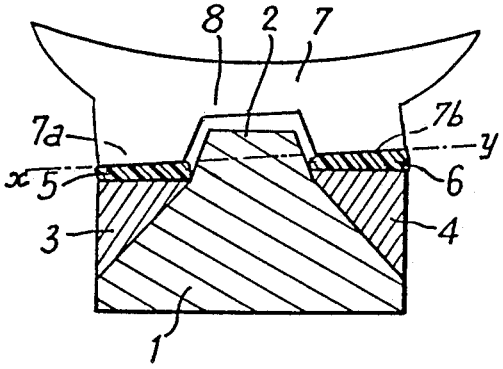

Referring to FIGS. 1–3, it can be seen that these figures represent a cross-country ski 1 whose cross-section is shaped in a manner so as to form a longitudinal upper guidance rib 2, having a cross-section substantially in the form of an isosceles trapezoid, defined by an upper horizontal surface 2*a* and two lateral inclined surfaces 2*b*and 2*c*. The upper guidance rib 2 is connected, by inclined lateral surfaces 2*d* and 2*e*, of a lesser slope than the lateral inclined upper surfaces 2*b* and 2*c*, to the respective sides 1*a*, 1*b* of ski 1. On the inclined lateral lower surfaces 2*d* and 2*e* there extend two longitudinal shaped applied sections 3 and 4, made of a relatively rigid material, each of which have a cross-section in the form of a right-angle triangle.

These shaped sections 3 and 4, respectively, include a vertical lateral surface 3*a* and 4*a*, which are preferably substantially coplanar with the respective side 1*a* and 1*b* of the ski; an upper substantially horizontal surface 3*b* and 4*b*extending to the guidance rib 2; and a lower inclined surface 3*c* and 4*c* constituting the hypotenuse, in cross-section, of the right-angle triangle. The inclined surfaces 3*c* and 4*c* of the shaped sections 3 and 4 are, respectively, in contact with the lateral inclined lower surfaces 2*d* and 2*e* and they have substantially the same slope.

According to the invention, the upper horizontal surfaces 3*b* and 4*b* of the shaped sections 3 and 4, respectively, carry elements 5 and 6 made of an elastic material. In FIGS. 1–3 elastic elements 5 and 6 have substantially the same thickness. However, the upper horizontal surface 4*b* of the right shaped section 4, which is assumed to be positioned on the exterior side of ski 1, is at a level greater than that of the upper horizontal surface 3*b* of the left shaped section 3, which is positioned on the interior side and, consequently, the level of the upper surface of the right or external elastic element 6 is at a higher level than that of the upper surface of the left or internal elastic element 5.

With the cross-country ski there cooperates a boot which is shown schematically only by its sole 7. This sole includes, in its central portion, a longitudinal groove 8, opened downwardly and having a trapezoidal cross-section corresponding substantially to that of the longitudinal guidance rib 2 of ski 1. This groove 8 is adapted to cap the guidance rib 2, in the course of flattening of the boot on ski 1, during cross-country skiing. The groove 8 defines, in the lower surface of sole 7, two horizontal support zones 7*a* and 7*b* positioned, respectively, on opposite sides of the central groove 8. These support zones 7*a* and 7*b* are adapted to press against the elastic elements 5 and 6 when the boot is flattened on the ski.

As can be seen in FIG. 2, during the flattening of the boot on the ski, the sole 7 first comes into contact with its right support zone 7*b*, with the upper surface of the external elastic element 6 which is positioned, in its entirety, at a level higher than that of the internal elastic element 5. The left support zone 7*a* of sole 7 then comes into contact with the upper surface of the internal elastic element 5.

At the end of the flattening of the boot on the ski, i.e., just before the beginning of the return movement ensuring the propulsion of the skier, the sole 7 occupies the position illustrated schematically in FIG. 3. By virtue of the offsetting in relative height of the two elastic elements 5 and 6, the boot is then slightly inclined transversely, from top to bottom and from the exterior towards the interior, as is indicated schematically by the line xy. Stated in another manner, the longitudinal median plane of the boot is inclined toward the interior of the ski with respect to the longitudinal median plane of the ski. At the beginning of the flattening movement of the boot, the elastic elements 5 and 6 are compressed and push the sole 7 upwardly.

Figure 4:
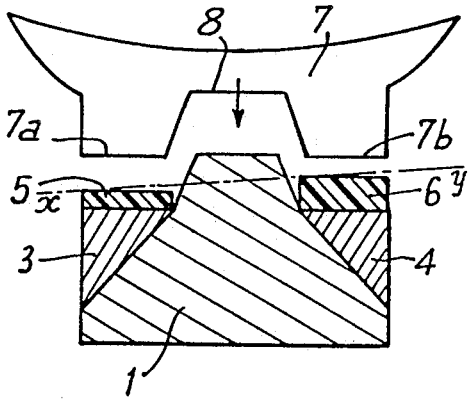
FIGS. 4–10 are views in vertical transverse cross-section of respective embodiments of the lateral guidance apparatus according to the invention.

In the alternative embodiment of the invention shown in FIG. 4, the shaped sections 3 and 4 have substantially the same height and the elastic elements 5 and 6 are thus situated at substantially the same level. However, the external elastic element 6 has a thickness greater than that of the internal elastic element 5. Here again, at the end of the flattening of the boot, the boot is inclined transversely, as is shown schematically by the line xy.

Figure 5:
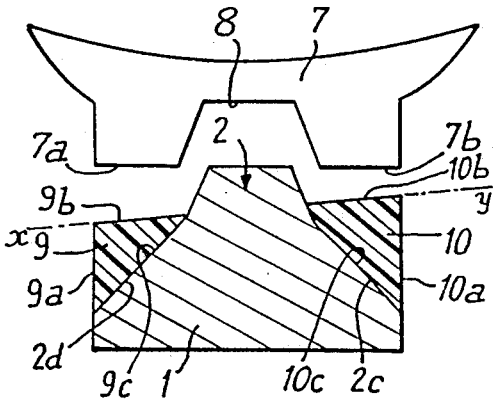

In the alternative embodiment of the invention shown in FIG. 5 the lateral guidance apparatus includes two shaped sections 9 and 10 which are totally made of an elastic material, and which are pressed and affixed directly on ski 1. These two shaped sections 9 and 10 each have a cross-section of triangular shape and they include lateral and vertical surfaces 9*a* and 10*a* which are substantially coplanar with the sides 1*a* and 1*b* of ski 1, upper surfaces 9*b* and 10*b* inclined with respect to the horizontal and positioned in substantially the same plane xy, and lower inclined surfaces 9*c* and 10*c*, respectively pressed against the lower inclined surfaces 2*d* and 2*e* of ski 1. The inclination of the upper surfaces 9*b* and 10*b* in the plane xy is such that the upper surface 10*b* of the external shaped section 10 is at a level higher than that of the upper surface 9*b* of the internal shaped section 9.

Figure 6:
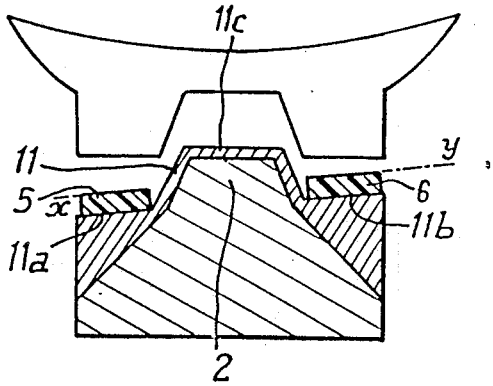

In the alternative embodiment of the invention shown in FIG. 6, the cross-country ski carries, at its upper portion, a molded shaped section 11 made of a rigid material which mates with the shape of cross-country ski 1. This shaped section 11 has two upper surfaces 11*a* and 11*b* positioned on opposite sides of the central rib 2 which is capped with a trapezoidal portion 11*c* of shaped section 11. The upper surfaces 11*a* and 11*b* are substantially coplanar and inclined with respect to the horizontal, in a manner such that the upper external surface 11*b* is positioned at a level greater than that of the internal upper surface 11*a*. Elastic elements 5 and 6, having substantially the same thickness, are affixed to respective upper surfaces 11*a* and 11*b*. Elements 5 and 6 are adapted to be compressed by the support zones 7*a* and 7*b* of sole 7, while giving to the boot a position which is inclined transversely along the line xy, upon the flattening of the boot on the ski.

In the alternative embodiments of the invention shown in FIGS. 7–10, the cross-country ski 1 has a cross-section which is substantially rectangular and which carries, on its upper horizontal surface 1*c*, a small plate 12, made of a relatively rigid material, in the central portion of which is formed a longitudinal guidance rib 15, which forms an integral portion of the plate 12 and defines, on plate 12, two horizontal wings, namely, an internal wing 12*a* and an external wing 12*b*.

Figure 7:
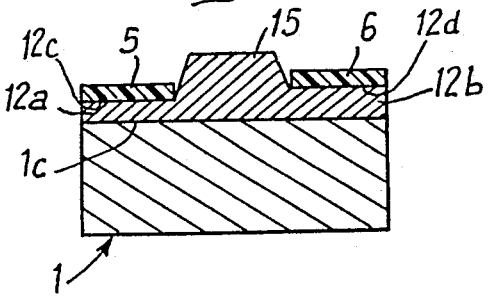

In the alternative embodiment shown in FIG. 7 the internal wing 12a of plate 12 has a thickness less than that of the external wing 12b. The two wings 12a and 12b carry, respectively, on their upper horizontal surfaces, elastic elements 5 and 6 having substantially the same thickness. As a result, the upper surface 12c of the external elastic element 6 is positioned at a level above the level of the upper surface 12d of the internal elastic element 5, as in the case of FIG. 1.

Figure 8:
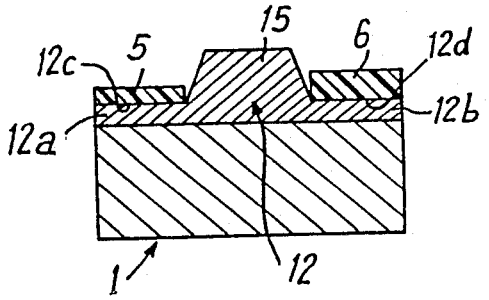

In the alternative embodiment of the invention shown in FIG. 8, the two wings 12a and 12b of plate 12 have substantially the same thickness and they carry, on their upper horizontal surfaces 12c and 12d, respective elastic elements 5 and 6 having different thicknesses. More particularly, the external elastic element 6 has a thickness greater than that of the internal elastic element 5, as in the case illustrated in FIG. 4.

Figure 9:
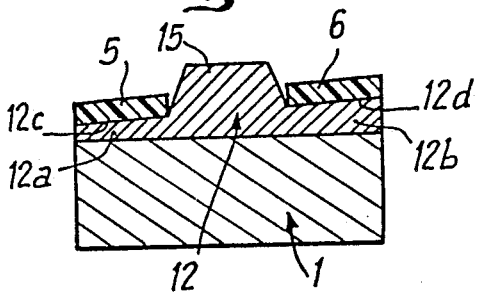

In the alternative embodiment of the invention shown in FIG. 9, the two wings 12a and 12b have upper respective surfaces 12c and 12d which are inclined with respect to the horizontal, in the xy plane, the upper internal surface 12c being lower than the external upper surface 12d. These inclined surfaces 12c and 12d carry, respectively, elastic elements 5 and 6 having substantially the same thickness, as in the case illustrated in FIG. 6.

Figure 10:
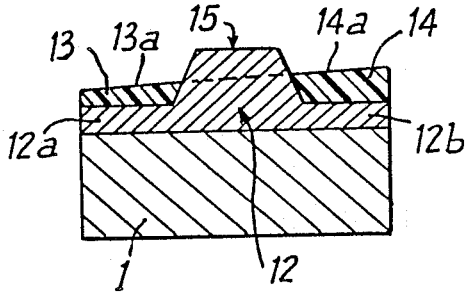

In the alternative embodiment of the invention shown in FIG. 10, the two wings 12a and 12b of plate 12 have substantially the same thickness and they carry, on their upper horizontal surfaces 12c and 12d, elastic elements 13 and 14 whose upper surfaces 13a and 14a are inclined with respect to the horizontal, in the plane xy, the upper surface 13a of the internal elastic element 13 being lower than the upper surface 14a of the external elastic element 14.

Figure 11:
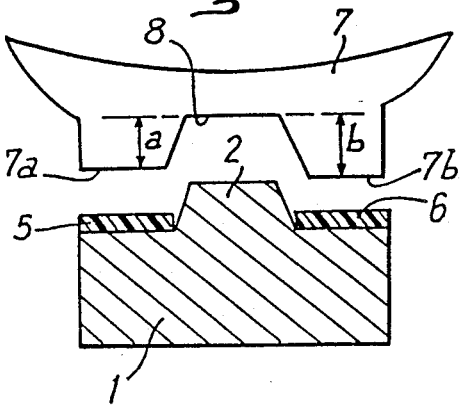
FIGS. 11 and 12 are vertical transverse cross-sectional views of a further embodiment illustrating, respectively, the ski boot being spaced from the rib and the ski boot positioned flat upon the ski.
Figure 12:
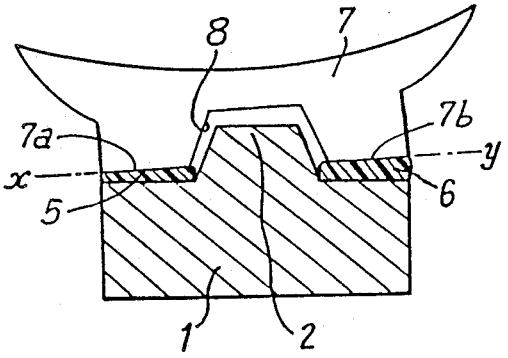
Figure 13:
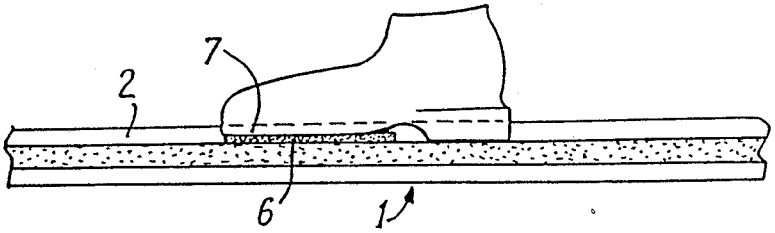
FIG. 13 is an elevational view of a cross-country ski provided with a lateral guidance apparatus of a boot according to the invention.

In the alternative embodiment of the invention shown in FIGS. 11 and 12, the two elastic elements 5 and 6, which are positioned on opposite sides of the longitudinal guidance rib 2, have substantially the same thickness and are positioned at substantially the same level. In this case, the two portions of the sole 7 which are defined on either side of the central groove 8 do not have the same height. More particularly, as can be seen in FIG. 11, the left or internal portion which includes the lower support zone 7a, has a height a, with respect to the bottom 8a of groove 8, which is less than the height b of the right or external portion of the sole which includes the lower support zone 7b. Consequently, here again, during the flattening of the boot on the ski, the boot is inclined transversely towards the interior, along the plane xy, as shown in FIG. 12.

Although the invention has been described with respect to particular materials, embodiments and means, it is to be understood that the invention is not limited to the particulars disclosed and extends to all equivalents within the scope of the claims.

What is claimed is:

1. Lateral guidance apparatus for a boot on a cross-country ski comprising, at an upper portion of said ski, a longitudinal rib having an internal side and an external side, said rib constituting a lateral guidance element for a boot having, in its sole, a longitudinal groove which caps the rib in the course of flattening said boot on the ski, said sole further having a lower support zone on either side of said groove, said lateral guidance apparatus further comprising two elastic elements positioned, respectively, on said internal side and on said external side of said longitudinal rib, each said elastic element having an upper surface, wherein said upper surfaces of said elastic external element and said elastic internal element and said lower support zones of said sole positioned on either side of said groove in said sole are positioned, with respect to one another, in a manner such that in the position of said sole substantially flattened on said ski, and when said two elastic elements are compressed, said sole is inclined transversely from top to bottom and from the external side of the ski towards the internal side of the ski, respectively.

2. Apparatus according to claim 1, wherein said external elastic element and said internal elastic element have substantially the same thickness and are positioned at substantially the same level and said lower support zone of said sole situated on said interior side of said ski has a first predetermined height, with respect to the bottom of said groove, which is less than a predetermined height of said lower support zone situated on the external side of the ski.

3. Apparatus according to claim 1 wherein said upper surfaces of said elastic external element and said elastic internal element are inclined downwardly from the external side of the ski to the internal side of the ski.

4. Apparatus according to claim 1, wherein said upper surface of said elastic element which is positioned on said external side of said ski is positioned at a level higher than the level of said upper surface of said elastic element which is positioned on said internal side of said ski.

5. Apparatus according to claim 4, further comprising an external shaped section and an internal shaped section affixed to said ski and having respective upper surfaces, wherein said external elastic element and said internal elastic element have substantially the same thickness and are, respectively, affixed on said horizontal upper support surfaces of said external shaped section and said internal shaped section, said horizontal support surface of said external shaped section is positioned at a level above that of said horizontal support surface of said internal shaped section.

6. Apparatus according to claim 4, further comprising an external shaped section and an internal shaped section affixed to said ski and having respective upper surfaces, wherein said external elastic element has a thickness greater than that of said internal elastic element, and wherein said external shaped section and said internal shaped section are affixed, respectively, on said horizontal support surfaces of said shaped sections, which are positioned substantially at the same level.

7. Apparatus according to claim 4, wherein said external elastic element and said internal elastic element are constituted by shaped sections totally made of elastic material, which comprise respective upper surfaces and which are substantially coplanar and inclined with respect to the horizontal, the inclination being such that said upper surface of said external shaped section is at a level above that of said upper surface of said internal shaped section.

8. Apparatus according to claim 4, further comprising a molded shaped section made of a relatively rigid material and substantially mating with the shape of said cross-country ski, said molded shaped section having upper support surfaces, respectively, on an external side and on an internal side of a portion of said molded shaped section which overlies said longitudinal rib, said upper support surfaces of said molded shaped section being substantially coplanar and inclined with respect to the horizontal such that said external upper support surface is positioned at a level above that of said internal upper support surface, and wherein said external elastic element and said internal elastic element have substantially the same thickness and are situated, respectively, on said external upper support surface and said internal upper support surface.

9. Apparatus according to claim 4, further comprising a plate affixed to said ski having an external wing and an internal wing with respective substantially horizontal upper surfaces, and wherein said longitudinal rib is formed integrally with said place between said wings, wherein said external elastic element and said internal elastic element have substantially the same thickness and are affixed, respectively, on said upper horizontal surfaces of said external wing and said internal wing of said plate, said internal wing having a thickness less than that of said external wing.

10. Apparatus according to claim 4, further comprising a plate affixed to said ski having an external wing and an internal wing with respective substantially horizontal upper surfaces, and wherein said longitudinal rib is formed integrally with said plate between said wings, wherein said external elastic element has a thickness greater than that of said internal elastic element, and wherein said two elastic elements are respectively affixed on said upper horizontal surfaces of said external wing and said internal wing of said plate.

11. Apparatus according to claim 4, further comprising a plate affixed to said ski having an external wing and an internal wing with respective upper surfaces, and wherein said longitudinal rib is formed integrally with said plate between said wings, wherein said external elastic element and said internal elastic element have substantially the same thickness and are affixed on said upper respective surfaces of said wings wherein said upper surfaces of said wings are substantially coplanar and inclined with respect to the horizontal such that said internal upper surface is lower than said external upper surface.

12. Apparatus according to claim 4, further comprising a plate affixed to said ski having an external wing and an internal wing with respective substantially horizontal upper surfaces, wherein said longitudinal rib is formed integrally with said plate between said wings, wherein said external elastic element and said internal elastic element are affixed on said upper horizontal surfaces of said external wing and said internal wing, wherein said external wing and said internal wing have substantially the same thickness, and wherein said upper surfaces of said elastic elements are substantially coplanar and are inclined with respect to the horizontal, such that said upper surface of said internal elastic element is lower than said upper surface of said external elastic element.

13. A lateral guidance apparatus for a ski boot comprising:

a longitudinal guidance element for being affixed to a ski and for engagement with a substantially complementary shaped groove in the sole of said boot;

an internal longitudinally extending support surface located on an internal side of said longitudinal guidance element;

an external longitudinally extending support surface located on an external side of said longitudinal guidance element;

said internal longitudinally extending support surface and said external longitudinally extending support surface being configured and arranged relative to said boot and said ski during the course of skiing such that a longitudinal median plane of said boot is inclined relative to a longitudinal medium plane of said ski in a downward direction from said external side to said internal side.

14. The lateral guidance apparatus of claim 13 wherein said internal longitudinally extending support surface and said external longitudinally extending support surface are inclined downwardly from said external side to said internal side.

15. The lateral guidance apparatus of claim 13 further comprising an internal elastic element and an external elastic element, wherein said internal elastic element comprises said internal longitudinally extending support surface, and wherein said external elastic element comprises said external longitudinally extending support surface.

16. The lateral guidance apparatus of claim 15 wherein said internal elastic element and said external elastic element have substantially the same thickness.

17. The lateral guidance apparatus of claim 15 wherein said internal elastic element and said external elastic element have different thicknesses.

18. The lateral guidance apparatus of claim 15 further comprising an internal shaped section for engagement with an internal ski surface and an external shaped section for engagement with an external ski surface, wherein said internal shaped section and said external shaped section each comprise an upper surface for supporting said internal elastic element and said external elastic element, respectively.

19. The lateral guidance apparatus of claim 18 further comprising a further section connecting said internal shaped section and said external shaped section, wherein said further section is configured and arranged for overlying said longitudinal guidance element.

20. The apparatus of claim 19 wherein said internal elastic element and said external elastic element have substantially the same thickness.

21. The apparatus of claim 13 further comprising a sole for said boot having said complementary shaped groove therein, said sole further comprising an internal lower support surface for engagement with said internal longitudinally extending support surface and an external lower support surface for engagement with said external longitudinally extending support surface wherein, when said internal lower support surface and said external support surface engage a horizontal support surface, said longitudinal median plane of said boot is inclined from vertical.

22. The apparatus of claim 21 wherein said sole further comprises an internal projection comprising said internal lower support surface and an external projection comprising said external lower support surface, wherein said external support projection has a height greater than a height of said internal support projection.

23. The apparatus of claim 13 further comprising a plate, in a longitudinally extending central portion of which said longitudinal guidance element projects.

24. The apparatus of claim 23 wherein said plate comprises a substantially continuous lower surface for engagement with a substantially continuous upper surface of said ski.

25. The apparatus of claim 24 further comprising an internal elastic element and an external elastic element, wherein said internal elastic element comprises said internal longitudinally extending support surface, and wherein said external elastic element comprises said external longitudinally extending support surface.

26. The apparatus of claim 24 wherein said internal elastic element and said external elastic element have substantially the same thickness.

27. The apparatus of claim 24 wherein said internal elastic element and said external elastic element have different thicknesses.

28. The lateral guidance apparatus of claim 13 in combination with a sole of a ski boot, said sole comprising:

an interior lower support surface on an interior side of said groove for engagement with said internal ski support surface;

an exterior lower support surface on an exterior side of said groove for engagement with external ski support surface wherein, when said interior lower support surface and said exterior support lower support surface engage said ski support surfaces, said ski boot sole tends to incline the lower leg of a skier towards said internal side of said ski when said ski boot is worn by said skier.

29. The sole of claim 28 further comprising an interior projection comprising said interior lower support surface and an exterior projection comprising said exterior lower support surface, wherein said exterior support projection has a height greater than a height of said interior support projection.

30. Lateral guidance apparatus for a boot on a cross-country ski comprising, at an upper portion of said ski, a longitudinal rib having an internal side and an external side, said rib constituting a lateral guidance element for a boot having, in its sole, a longitudinal groove which caps the rib in the course of flattening said boot on the ski, said sole further having a lower support zone on either side of said groove, said lateral guidance apparatus further comprising two elastic elements positioned, respectively, on said internal side and on said external side of said longitudinal rib, each said elastic element having an upper surface, wherein said upper surfaces of said elastic external element and said elastic internal element and said lower support zones of said sole positioned on either side of said groove in said sole are positioned, with respect to one another, in a manner such that in the position of said sole substantially flattened on said ski, and said two elastic elements are equally compressed, said sole is inclined transversely from top to bottom and from the external side of the ski towards the internal side of the ski, respectively.

31. A lateral guidance apparatus for a ski boot comprising:

a longitudinal guidance element adapted to be affixed to a ski and adapted to be received in a generally complementary shaped groove in the sole of said boot;

an internal longitudinally extending support surface located on an internal side of said longitudinal guidance element;

an external longitudinally extending support surface located on an external side of said longitudinal guidance element;

said internal longitudinally extending support surface and said external longitudinally extending support surface being configured and arranged relative to said boot and said ski such that a longitudinal medium plane of said boot is induced to be inclined downwardly from the external side to the internal side of said ski relative to a longitudinal median plane of said ski when said boot is supported by said internal support surface and said external support surface.

* * * * *

UNITED STATES PATENT AND TRADEMARK OFFICE

CERTIFICATE OF CORRECTION

PATENT NO. : 4,961,591

DATED : October 9, 1990

INVENTOR(S) : A. Bejean et al

It is certified that error appears in the above-identified patent and that said Letters Patent is hereby corrected as shown below:

At col. 4, line 1, change "eternal" to --external--.

At col. 6, line 43, insert --1-- after "ski".

At col. 11, line 16, insert --said-- after "with".

At col. 12, lines 29-30, change "medium" to --median--.

Signed and Sealed this

Thirteenth Day of April, 1993

*Attest:*

STEPHEN G. KUNIN

*Attesting Officer*

*Acting Commissioner of Patents and Trademarks*